US005915637A

United States Patent [19]

Parsons

[11] Patent Number: 5,915,637

[45] Date of Patent: Jun. 29, 1999

[54] PILL CRUSHER

[75] Inventor: J. Stuart Parsons, Laguna Nigel, Calif.

[73] Assignee: Links Medical Products Inc., Aliso Viejo, Calif.

[21] Appl. No.: 09/185,918

[22] Filed: Oct. 4, 1998

Related U.S. Application Data

[63] Continuation-in-part of application No. 29/090,655, Jul. 14, 1998, Pat. No. Des. 405,889.

[51] Int. Cl.[6] ..... B02C 1/00

[52] U.S. Cl. ..... 241/168; 241/169; 241/DIG. 27

[58] Field of Search ..... 241/169, DIG. 27, 241/168, 169.2

[56] References Cited

U.S. PATENT DOCUMENTS

| | | | |
|---|---|---|---|
| 651,455 | 6/1900 | Bolton, Jr. | 241/169 |
| 854,384 | 5/1907 | Ross | 241/169 X |
| 979,364 | 12/1910 | Baudement et al. | 241/169 |
| 2,046,396 | 7/1936 | Matter et al. | 241/169 |
| 2,047,566 | 7/1936 | Klingler | 241/169 |
| 3,915,393 | 10/1975 | Elkins | 241/168 |
| 4,209,136 | 6/1980 | Linden et al. | 241/169.2 |
| 4,341,356 | 7/1982 | Hiott et al. | 241/169.2 |
| 4,694,996 | 9/1987 | Siegel | 241/100 |
| 4,763,847 | 8/1988 | Vosburgh | 241/169 |
| 5,025,996 | 6/1991 | Lavin et al. | 241/168 |
| 5,067,666 | 11/1991 | Sussman | 241/36 |
| 5,123,601 | 6/1992 | Lavin et al. | 241/168 |
| 5,531,386 | 7/1996 | Jensen | 241/36 |

*Primary Examiner*—John M. Husar
*Attorney, Agent, or Firm*—William Patrick Waters

[57] ABSTRACT

A pill crusher having an elongated base, an anvil integrally fixed to the base, a movable handle and a compression link, pivotally coupled to the base and pivotally connected to the handle, for facilitating rotational movement of the handle relative to the base. A platen is coupled pivotally to an anchor block on the base and connected at the other end to the handle so that movement of the handle produces movement of the platen relative to the anvil, for crushing a pill between the two. A pouch is provided, for receiving a pill to be crushed. It is adapted to fit in a mouth defined by the anvil and the platen. The pill crusher includes a cover fixed to the base and disposed above the rear anchor block, the cover providing an onboard dispenser for a plurality of pouches.

19 Claims, 2 Drawing Sheets

PILL CRUSHER

CROSS REFERENCE TO RELATED APPLICATION

This is a continuation in part patent application of patent application Ser. No. 29/090,655, filed Jul. 14, 1998 titled PILL CRUSHER, now U.S. Pat. No. D. 405,889

BACKGROUND OF THE INVENTION

The present invention relates generally to patient care devices and, more particularly, to pill crushing devices.

Modern medicines come in a variety of forms and commonly the form is that of a pill. This can be defined generally as a small, usually soluble medicated mass that is shaped to facilitate swallowing. Typically, it contains a filler and an excipient substance that facilitates working it into the desired pillular form. One skilled in the art of patient medication may distinguish between a "pill" and a "tablet" but, as the term is used herein, "pill" is intended to include both. Typically, pills come in a variety of sizes and shapes, and, because of the manufacturing process, often have a hard outer shell.

In some cases, to accomplish efficient patient medication, it is advisable to crush the pill rather than having the patient consume it whole. For example, if a patient has difficulty in swallowing, it can be helpful to pulverize the pill and combine the fragments with a carrier, such as a fruit juice. Because of this recognized need, various pill crushing devises are known.

Since pill crushing devices are used in a patient care setting, it is important that they be reliable, quiet in operation and readily usable by care giving personnel. Conventional pill crushers sometimes fall short of these goals. For example, some prior art devices afford little mechanical advantage and rely on impact forces for crushing. These devices make the pill crushing operation difficult and inefficient. Further, use of such devices can be a noisy affair and this can be a substantial limitation when it is important not to disturb a patient.

Thus, there is a need for a pill crusher that is effective, efficient and relatively quiet in operation. Ideally, such a device would not require impact forces to crush a pill.

In addition to the above mentioned limitations of conventional devices, another problem is presented by devices which use a crucible or cup in which the pill is crushed. If the user is not careful, residue from a prior crushing could be left in the crucible which would then be mixed with another medication, possibly intended for another patient. Such cross contamination could be dangerous in some cases.

In view of the foregoing, there is a need for a pill crusher which is quiet in operation and which affords the user a substantial mechanical advantage to afford ease of operation. Ideally, such a pill crusher would not require impact forces to accomplish pulverization. In addition, it would efficiently and effectively reduce the likelihood of contaminating the medication of one patient with that of another. Desirably, such a pill crusher would be relatively inexpensive to manufacture, be composed of readily available material and would be compact and light in weight.

DISCLOSURE OF THE INVENTION

Disclosed herein is a pill crusher that is quiet in operation and which does not rely on impact forces to crush pills. It is effective, efficient and convenient in use, having a capability of crushing simultaneously one or a plurality of pills in a relatively noiseless manner.

The preferred embodiment of the present invention is a pill crusher having an elongated base, an anvil integrally fixed to the base, a movable handle and a compression link, pivotally coupled to the base and pivotally connected to the handle, for facilitating rotational movement of the handle relative to the base. A platen is coupled pivotally to an anchor block on the base and connected at the other end to the handle so that movement of the handle produces movement of the platen relative to the anvil, for crushing a pill between the two. A pouch is provided, for receiving a pill to be crushed. It is adapted to fit in a mouth defined by the anvil and the platen. The pill crusher includes a cover fixed to the base and disposed above the rear anchor block, the cover providing an onboard dispenser for a plurality of pouches.

The preferred embodiment of the invention affords several advantages. It is quiet and efficient in operation while relying on pressure, not impact forces, to accomplish pill crushing. By eliminating a need for a crucible, it reduces substantially the danger of inadvertent mixing of medications. Further, by providing an onboard pouch dispenser, the device enables the user to access the pouches in a convenient manner.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
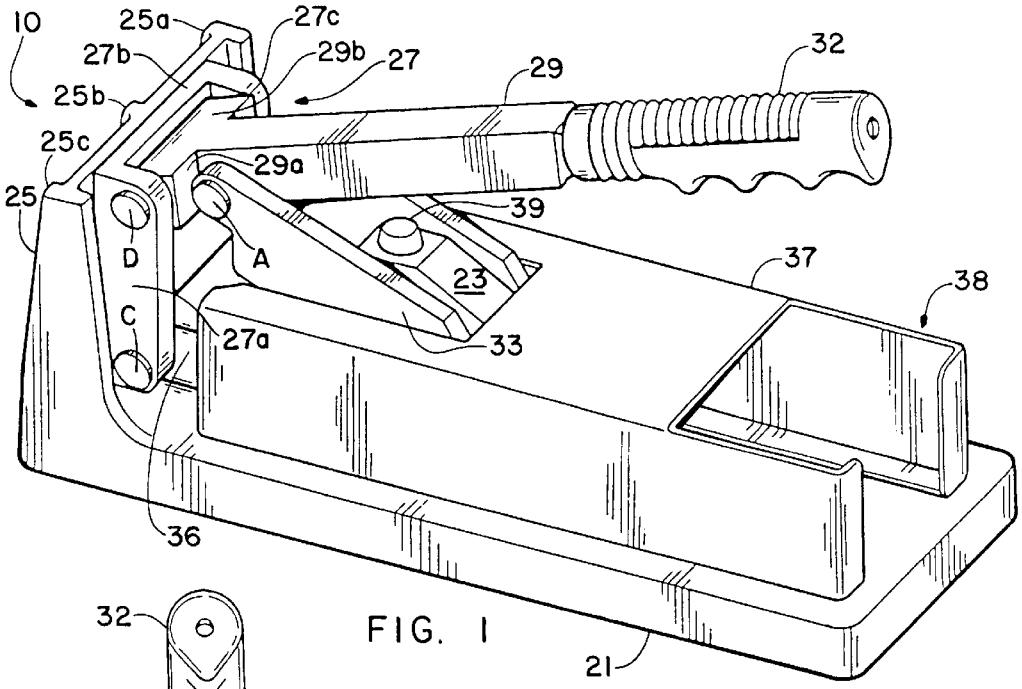
FIG. 1 is a perspective view of a pill crusher of the present invention.
Figure 2:
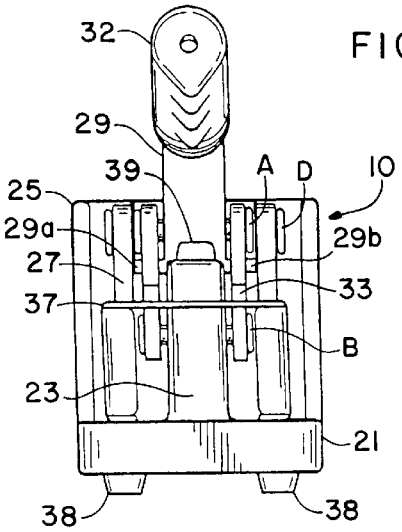
FIG. 2 is a rear elevational view of the pill crusher of FIG. 1.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

In the following detailed description and in the several figures of the drawings, like elements are identified with like reference numerals.

With reference now to the drawings, there is shown a novel pill crusher 10 which is constructed according to a preferred embodiment of the present invention. The pill crusher 10 includes an elongated, generally rectangular base 21 from which an integrally formed anvil 25 projects upwardly. A forward anchor block 36 is integrally formed at the upper surface of the base 21 and a platen 27 is pivotally connected thereto by a pin or pivot C, for rotational movement of the platen 27 against the anvil 25. A handle 29 is pivotally connected to the platen 27, at an upper end thereof, by a pin or pivot D.

A rear anchor block 23, integrally formed with the base 21, is located rearward of the forward anchor block 36. A compression linkage 33 is pivotally connected to the block 23 by a pin or pivot B and, in addition, the linkage 33 is pivotally connected to the handle 29 by a pin or pivot A A strengthening rib 31, integrally formed with the base 21, the forward anchor block 36, and the rear anchor block 23, helps to limit distortion of the base 21 during operation of the pill crusher 10. A housing 37 covers a substantial portion of the base 21 and is attached thereto, in a conventional manner, at the upper surface thereof. The cover 37 is opened rearwardly to afford access to a storage and dispensing area 38 for a plurality of pouches, exemplary of which is the pouch 50 shown in FIG. 6.

A shock absorbing bumper 39 is affixed to the top of the rear anchor block 23 for cushioning downward movement of the handle 29 during operation of the pill crusher 10. In this regard, the bumper 39 helps to ensure quiet operation of the pill crusher. The handle 29 has a resilient rubber-like grip 32 to facilitate easy handling thereof. A plurality of legs 38 support the base 21 and support it above a table or counter surface for ease of operation.

Some other components of the pill crusher 10 will now be considered in greater detail. It is apparent to one skilled in the art that the device utilizes a compound lever to move the platen 27 and, as a result, great forces are brought to bear against the anvil 25. To enable the anvil 25 to withstand such forces, ribs 25*a*, 25*b* and 25*c* are integrally formed with the anvil 25 to strengthen it. The platen 27 also sustains great loads and it is strengthened by wings 27*a* and 27*b*, each of which flanks a plate 27*b*. It will be noted, with reference to FIG. 1, that the combined width of the plate 27*b* and the pair of wings 27*a* and 27*c* provides a platen which fits between the anvil ribs 25*a* and 25*c* to ensure a substantially enclosed mouth 41 for the pill crushing process.

Since the crushing process is efficiently accomplished when the platen 27 is driven directly forward, wings 29*a* and 29*b*, integrally formed in the handle 29, cooperate with the platen wings 27*a* and 27*c* to constrain lateral movement of the platen 27.

Figure 1A:
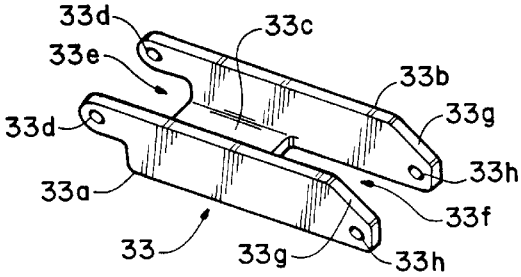
FIG. 1A is an illustrative view of a compression linkage of the pill crusher of FIG. 1.
Figure 3:
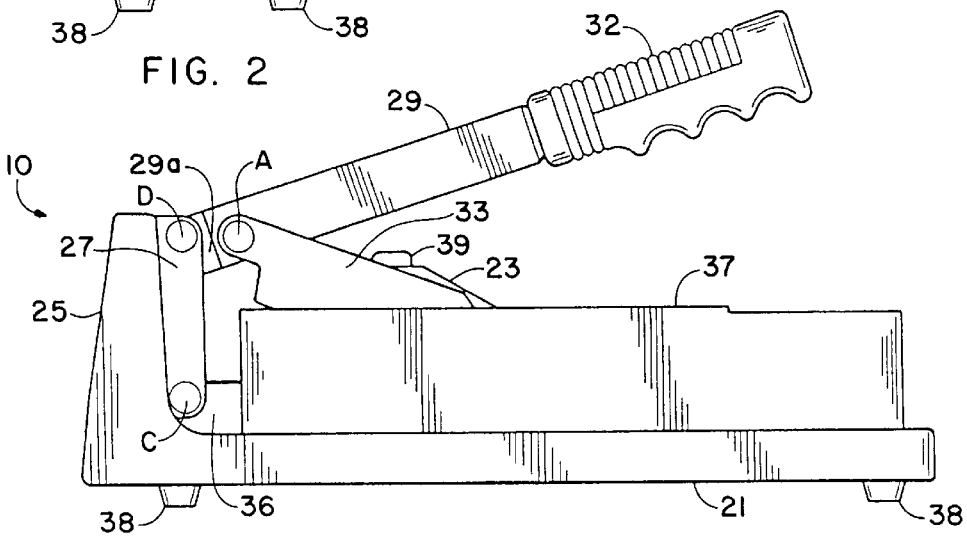
FIG. 3 is a side elevational view of the pill crusher of FIG. 1.

Considering now the compression linkage 33, with reference to FIG. 1A, the linkage is generally channel shaped, having a bottom wall 33*c* and integrally connected side walls 33*a* and 33*b*. The side walls have openings 33*d* formed in the forward portions thereof for receipt therethrough of the pivot A. Similarly, openings 33*h*, formed in the rearward portions of the side walls 33*a* and 33*b* are adapted for receipt of the pivot B. A cutaway opening 33*e* is formed in the forward portion of the linkage 33 and another cutaway opening 33*f* is formed in the rearward portion of the linkage 33. The openings 33*e* and 33*f* permit clearance of the linkage 33 between the platen 27 and the rear anchor block 23, respectively, during pill crusher 10 operation.

Figure 5:
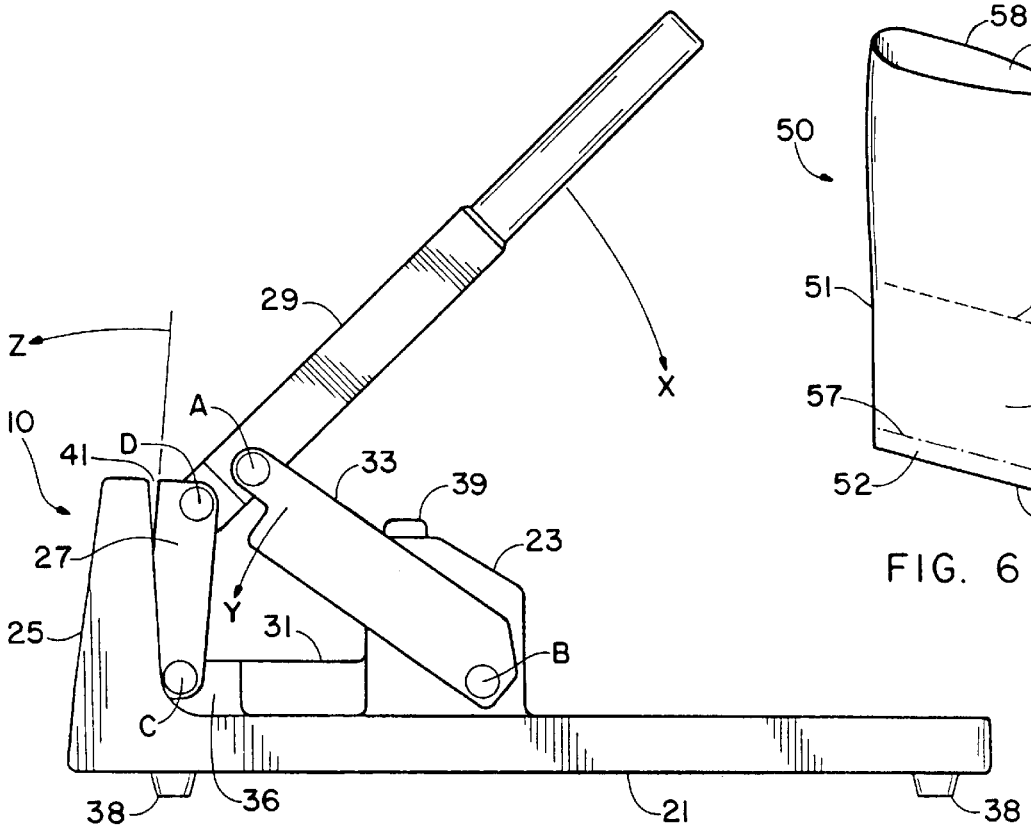
FIG. 5 is a side elevational view of the pill crusher of FIG. 1, showing the housing removed and the handle in a pill receiving position.

The operation of the pill crusher 10 will now be considered in greater detail in respect of a pill crushing process. During the pill crushing operation, the pins C and B act as fixed pivots, kept as they are within the respective front and rear anchor blocks 36 and 23, respectively, while the pivot A acts as a fulcrum pivot and the pivot D acts as a floating pivot. After a pouch 50, containing one or more pills, is placed in the mouth 41, the handle 29 is moved in a direction indicated by the letter X (FIG. 5). As the handle moves downwardly, a triangle formed by the legs AB, AD, and DB tends to collapse. Simultaneously, the compression linkage 33 begins to move in the direction indicated by the letter Y as the pivots D, A and B tend to move into alignment. Of course, true alignment is never achieved since the force which would be thereby realized would be excessive and would destroy the pill crusher 10 by fractured separation of the anvil 25 from the base 21. In order to prevent such an event, the anchor pivot B is fixed at a location short of an alignment position. In this manner, an efficient, powerful crushing action is achieved while destruction of the device 10 is avoided.

As the DAB triangle collapses, the action pivot D moves forwardly and the platen 27 rotates about the pivot C, as shown by the arrow Z (FIG. 5), to move against the anvil 25, thereby crushing any pill therebetween. It will be noted, with reference to FIG. 5, that the opening of the mouth 41 is greater at the top of the pill crusher 10 than it is nearer the pivot C. As a result, greater crushing forces come to bear the closer the pill is placed to the pivot C. As discussed more fully below, this characteristic can give the user of the pill crusher 10 flexibility in accomplishing the amount of pill crushing or pulverization desired.

Figure 4:
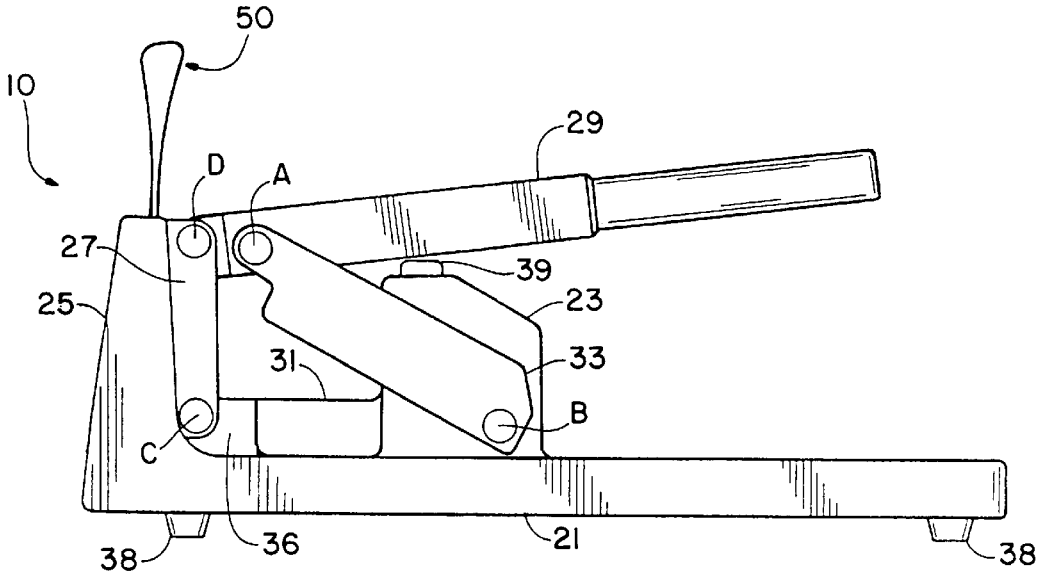
FIG. 4 is a side elevational view of the pill crusher of FIG. 1, showing the housing removed and the handle in a pill crushing position.
Figure 6:
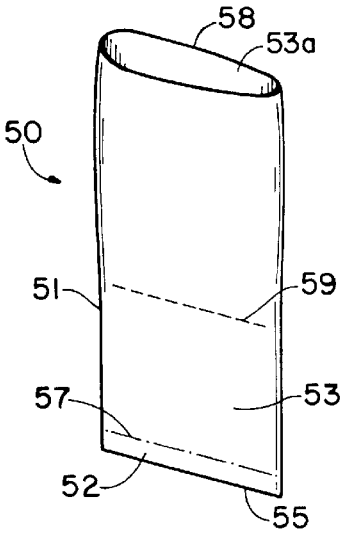
FIG. 6 is a front elevational view of a pouch adapted for use with the pill crusher of FIG. 1.

Considering further the pouch 50, as shown in FIG. 6, it is formed from a single sheet of transparent flexible sheet material such as polyethylene. The sheet is formed in a conventional manner to provide pouch sides, such as the side 51, a front panel 53 and a back panel 53*a* and a sealed bottom 55. A minor panel 52, an integral part of the front panel 53 is folded over and sealed against the back panel 53*a* at a seal line 57 to provide a leak tight container. The aforementioned panels are unsealed at their tops and an opening 58 is, thus presented. Indicia such as the indicia 59 are stamped or printed on the pouch 50 and the indicia can be helpful in orienting the pouch within the pill crusher 10 (FIG. 4). The configuration of the pouch 50 is particularly adapted for use with the pill crusher 10, having a width that conforms to the width of the mouth 41 of the pill crusher 10.

In operation, a pouch is removed from the pouch dispenser 38 and one or more pills are placed therein. It is recommended that the pouch 50 be not filled beyond the indicia 57, shown as a dotted line on the front panel 53. Often, the pouch 50 will hold a plurality of pills, typically as many as five depending on the size thereof. The pouch 50 containing the pills can then be inserted into the mouth 41 and, depending upon the degree of crushing desired, the position of the pouch can vary within the mouth 41 wherein greater crushing forces are available the nearer the pouch 50 is to the pivot C. An advantage of the present invention is that the user can repeat the crushing operation, with the pouch 50 at a suitable level within the mouth 41, until the desired amount of pulverization is realized. In this regard, the transparent panels of the pouch 50 help the user determine whether additional crushing is needed.

As additional evidence of the flexibility of the pill crusher 10, the pouch 50 can be introduced from the top of the mouth 41 or it may be inserted between the anvil 25 and the platen 27 from a side, at the convenience of the user. After This choice is made, the user lifts the handle 29 to open the mouth 41 and inserts the loaded pouch 50. The handle 29 is then moved downwardly in the direction of the arrow X (FIG. 5) to pulverize the pills. It is sometimes helpful to move the pouch 50 up and down within the mouth 41 while during the crushing process in order to achieve a suitable degree of pulverization.

Advantageously, the use of the pouch 50 ensures that all of the medication intended for the patient is available and none of it is lost in transfer from a crucible into another container since the user can simply pour the pulverized pill particles from the pouch 50 into a suitable container. Still further, the on board dispenser 38 provides a clean and orderly place for pouch storage, readily at hand, for use during the pill crushing processing.

Thus, a clean and efficient technique of crushing pills is provided. In addition, because the dispenser is of an open design, the supply of pouches 50 can readily monitored and replenished as required.

The pill crusher 10 is composed, substantially, of non-corrosive metal. In a preferred embodiment, the pins or pivots A, B, C and D are of rolled steel composition, having a diameter of about ¼ inch to about ½ inch, with about ¼ inch being preferred.

It will be apparent from the above description of the pill crusher 10 that it affords several distinct advantages when compared to the prior art. In the first place, efficient and effective pill crushing can be readily achieved with little exertion on the part of the user. Attendant with this is the fact that the crushing operation is essentially noiseless so that the health provider can use the device 10 even in proximity to a sleeping patient, without fear of waking the patient. In addition, the use of the pouch 50 insures that trace medications are not left in the device 50 to contaminate medications subsequently introduced into the device. Thus, a measure of patient safety is realized.

With regard to the pouch 50, it is apparent that it represents an advance in the art. It is low in cost to produce and thus is disposable economically after one time use. This factor, in addition to the capability for segregating the medicines of individual patients, helps to reduce, if not eliminate, problems of medicinal cross contamination. Additionally, the pouch 50 can hold a plurality of pills so that the patient can receive a beneficial mix of medicines simultaneously. The pouch 50 is relatively long and narrow and it permits pill pulverizing to occur at a remote site with subsequent transportation to the patient without great concern of contamination of the pouch contents. Because it is transparent, the pouch 50 enables the user to determine readily when a desired level of pill pulverization has occurred. Finally, the pouch 50 can be sealed conventionally, by heat sealing for example, so that the process of pill pulverization can be accomplished at a convenient time for the care giver, with medicine administration occurring as needed, at a later time.

From the foregoing it will be appreciated that the pill crusher provided by the invention provides an efficient, relatively noiseless and safe technique for pulverizing pills in a patient care environment. The assembly is mechanically simple and reliable. It is compact and requires only a modest amount of counter space. In addition, the onboard dispenser provides convenient access to pouches, as the need arises.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A device for crushing a pill, comprising:

a base;

an anvil integrally fixed to said base;

a movable handle;

a compression link, pivotally coupled at a first pivot to said base and coupled at a second pivot to said handle, for facilitating movement of said handle relative to said base; and a platen, coupled at a third pivot to said base and coupled at a fourth pivot to said handle, whereby movement of said handle produces movement of said platen relative to said anvil, for crushing a pill between said anvil and said platen.

2. The device according to claim 1 including a pouch for receiving a pill to be crushed wherein said pouch is adapted for fitting between said anvil and said platen.

3. The device according to claim 1 wherein said base is elongated, having a front end and a rear end and said device includes a forward anchor block and a rear anchor block, each one of said blocks being fixed to said base.

4. The device according to claim 3 including a cover fixed to said base and disposed over said rear anchor block, said housing including means for storing a plurality of pill receiving pouches.

5. The device according to claim 3 wherein said rear anchor block includes a bumper for cushioning shock from handle movement and for reducing noise during device operation.

6. The device according to claim 3 including a strengthening rib, fixed to said base, and disposed between and connected to said forward anchor block and said rear anchor block.

7. The device according to claim 3 wherein said compression link is pivotally connected to said rear anchor block.

8. The device according to claim 3 wherein said platen is pivotally connected to said front anchor block.

9. The device according to claim 1 wherein said compression linkage is generally channel shaped, having a bottom wall and integrally formed side walls.

10. A device for crushing a pill, comprising:

a base;

an anvil integrally fixed to said base;

a movable handle;

a platen, coupled at a fixed pivot to said base and coupled at a floating pivot to said handle, whereby movement of said handle produces movement of said platen relative to said anvil, for crushing a pill between said anvil and said platen; and means for moving forcibly said platen against said anvil when said handle is moved from a first position to a second position, said moving means including a compression link fixed at a first pivot to said base and at a second pivot to said handle wherein said second pivot functions as a fulcrum during handle movement.

11. The device according to claim 10 including a pouch for receiving a pill to be crushed wherein said pouch is adapted for fitting between said anvil and said platen.

12. The device according to claim 10 wherein said base is elongated, having a front end and a rear end and said device includes a forward anchor block and a rear anchor block, each one of said blocks being fixed to said base.

13. The device according to claim 12 including a cover fixed to said base and disposed over said rear anchor block, said housing including means for storing a plurality of pill receiving pouches.

14. The device according to claim 12 wherein said rear anchor block includes a bumper for cushioning shock from handle movement and for reducing noise during device operation.

15. The device according to claim 12 including a strengthening rib, fixed to said base, and disposed between and connected to said forward anchor block and said rear anchor block.

16. The device according to claim 12 wherein said compression link is pivotally connected to said rear anchor block.

17. The device according to claim 12 wherein said platen is pivotally connected to said front anchor block.

18. The device according to claim 10 wherein said compression linkage is generally channel shaped, having a bottom wall and integrally formed side walls.

19. A device for crushing a pill when the pill is enveloped in a pouch, comprising:

a base;

an anvil integrally fixed to said base;

a movable handle;

a platen, coupled at a pivot to said base and coupled at another pivot to said handle, whereby movement of said handle produces movement of said platen relative to said anvil, for crushing a pill between said anvil and said platen;

means for moving forcibly said platen against said anvil when said handle is moved from a first position to a second position said means including a compression link coupled at a pivot to said base and coupled at a fulcrum pivot to said handle; and means, located on said device, for storing a plurality of pouches.

* * * * *